US005203102A

United States Patent [19]

Mötteli

[11] Patent Number: 5,203,102

[45] Date of Patent: Apr. 20, 1993

[54] DEVICE ON ROTARY SNOW PLOUGH

[76] Inventor: Paul Mötteli, Ackersteinstrasse 111, 8049 Zürich, Switzerland

[21] Appl. No.: 797,958

[22] Filed: Nov. 26, 1991

[30] Foreign Application Priority Data

Dec. 6, 1990 [CH] Switzerland ..... 03863/90

[51] Int. Cl.[5] ..... E01H 5/09

[52] U.S. Cl. ..... 37/248; 37/252; 37/244; 37/251

[58] Field of Search ..... 37/242, 244, 248, 249, 37/250, 251, 252, 253, 254, 255, 256, 263

[56] References Cited

U.S. PATENT DOCUMENTS

| | | | |
|---|---|---|---|
| 1,701,787 | 2/1929 | Messlin | 37/252 X |
| 2,166,667 | 7/1939 | Watkins | 37/251 X |
| 2,426,507 | 8/1947 | Inksetter | 37/227 |
| 2,777,217 | 1/1957 | Klauer | 37/251 X |
| 2,785,482 | 3/1957 | Croce et al. | 37/256 |
| 3,395,466 | 8/1968 | Klapprodt | 37/252 |
| 3,512,279 | 5/1970 | Benson | 37/244 |
| 4,188,738 | 2/1980 | Vohl | 37/251 X |

FOREIGN PATENT DOCUMENTS

| | | | |
|---|---|---|---|
| 111918 | 9/1944 | Sweden | 37/251 |
| 186774 | 10/1936 | Switzerland . | |
| 566023 | 12/1944 | United Kingdom | 37/256 |

*Primary Examiner*—Dennis L. Taylor
*Assistant Examiner*—Arlen L. Olsen
*Attorney, Agent, or Firm*—Cushman, Darby & Cushman

[57] ABSTRACT

A rotary snow plough includes a ploughing drum, a running gear and a motor drive. A holding-down member is connected to the running gear and is arranged in front of the ploughing drum. The holding-down member includes upwardly directed holding-back surfaces. During operation, the rotating ploughing drum creates an upward reaction force, and snow lying above the holding-down surface creates an opposing downward reaction force. The effect developed by the holding-back surfaces is greater, the greater the upwardly directed reaction force, which arises from the quantity and quality of the snow.

5 Claims, 2 Drawing Sheets

DEVICE ON ROTARY SNOW PLOUGH

BACKGROUND OF THE INVENTION

1. Field of the Invention

The invention relates to a device on a rotary snow plough.

2. Description of the Related Art

In rotary snow ploughs, there is fundamentally the problem that, during the ploughing work, the plough not only moves forwards but, as a result of the direction of rotation of the ploughing drum, also has the tendency to move on a rising path, leaving behind a layer of snow of increasing height. In rotary ploughs, the running gear of which is formed by a single-axle tractor, this tendency is particularly noticeable. In a known rotary snow plough of this type, bearing weights are therefore provided, which are arranged as far in front of the wheel axle as possible. Although these make the lifting of the ploughing drum in the direction of a tipping movement about the wheel axle more difficult, their effect is in most cases, however, not sufficient to prevent the lifting of the ploughing drum and, for example, to make clearing on asphalt in one pass possible.

SUMMARY OF THE INVENTION

The aim of the invention is to produce an inexpensive device which, in a simple manner, makes it possible to carry out the clearing process using the rotary snow plough to a large extent unaffected by the forces which are released during snow clearance.

The effectiveness of the device according to the invention adapts automatically to a very great extent to the snow conditions and, in particular, the snow quality. If it is dry new snow or if the snow height is low, the holding-down force produced is small. However, the ploughing treatment likewise only releases small, upwardly acting reaction forces. On the other hand, a greater holding-down force is automatically set against the greater reaction forces caused by heavier snow, from the greater density of the snow layer.

The device is moreover suited to avoiding undesirable contact of the ploughing drum with an obstacle lying in the direction of travel.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

Two exemplary embodiments of the device according to the present invention are explained below with the aid of the drawings, in which:

DETAILED DESCRIPTION OF THE PRESENTLY PREFERRED EXEMPLARY EMBODIMENTS

Figure 1:
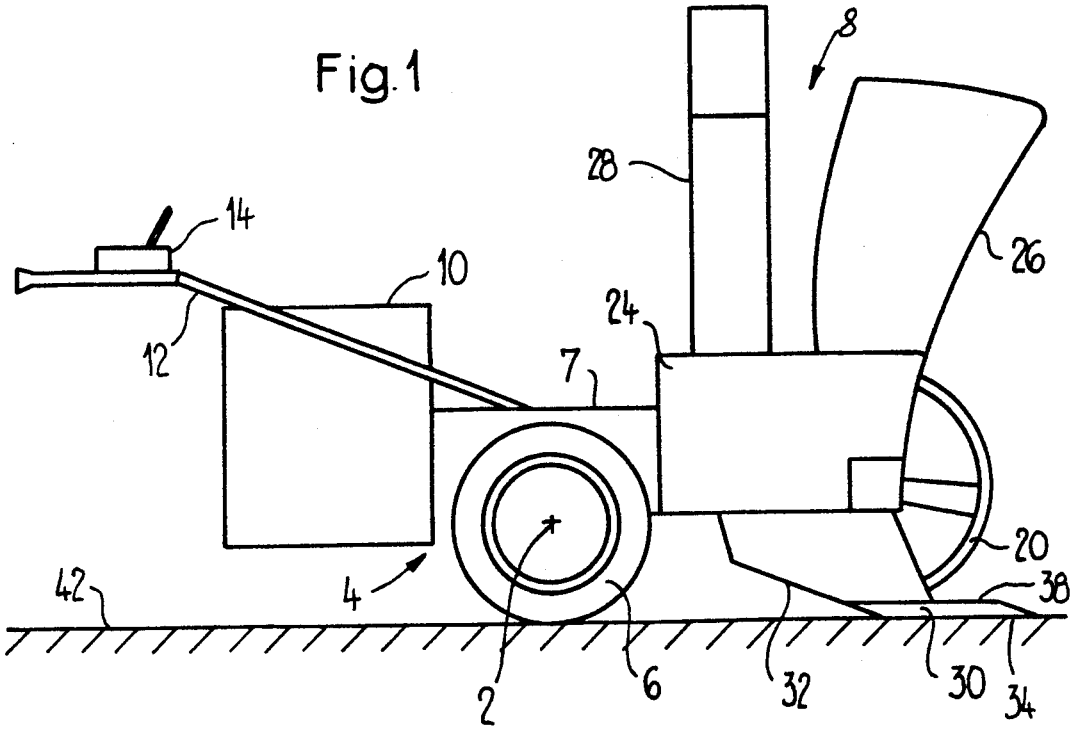
FIG. 1 shows diagrammatically in side view a first embodiment of a rotary snow plough having the device according to the invention.

The rotary snow plough illustrated in FIG. 1 has a single wheel axle, indicated by 2, of a running gear 4 with two driven, tired wheels 6 and a gear case 7. Built onto the gear case 7 in the direction of travel is a ploughing apparatus 8 equipped with a rotary device, and flanged onto it in the opposite direction is an internal combustion engine 10. Behind the internal combustion engine 10, a steering fork 12 ends, which is connected rigidly to the gear case 7. Operating members 14, attached to the steering fork, are used to control the engine 10 and the ploughing apparatus 8.

The running gear 4 forms, together with the gear case 7 and the engine 10, a single-axle tractor. This could in principle also be designed as a multi-axle vehicle.

The ploughing apparatus 8 has a cylindrical ploughing drum 20, the rotation axle 22 (FIG. 2) of which runs parallel to the wheel axle 2 and is mounted in a housing 24. The ploughing apparatus 8 moreover comprises a shield part 26 and a discharge channel 28.

According to the invention, the rotary snow plough is equipped with a device which comprises holding-down members in the form of sliding shoes 30. One elongate sliding shoe 30 is fastened, running in the direction of travel, to each of the two lower side edges of the housing 24 via a connection piece 32 associated with the sliding shoe. The sliding shoe 30 extend with their sliding surface 34 approximately tangential to the wheels 6. In this connection, the length of the connection piece 32 is chosen in such a manner that the ploughing drum 20, when the sliding surface 34 rests on a plane ground surface 42, remains raised from this ground surface by a slight distance. As can further be seen from FIG. 2, the sliding shoes 30, which run parallel to one another, are situated laterally outside the working area of the ploughing drum 20, when seen in plan view. The sliding shoes 30 project in the direction of travel by the dimension 36 beyond the area of action of the ploughing drum 20 and have flat upper sides 38 over the greater part of their longitudinal extension. The front ends 40 of the sliding shoes 30 are of wedge-shaped design and, more precisely, such that the upper sides 38 taper downwards. The upper sides 38 form holding-back surfaces.

In the operation of the rotary snow plough, the ploughing drum 20 rotates in the clockwise direction with reference to the illustration according to FIG. 1, in order to feed the ploughed-off snow to the rotary unit (not shown) and to carry it away through the discharge channel. The reaction force resulting from this direction of rotation during the ploughing work consequently points upwards and results, in relation to the wheel axle 2, in a tipping moment which tends to raise the ploughing apparatus 8 and, thus, the ploughing drum 20. The size of the reaction force depends upon the snow quality.

The device according to the present invention then works against the result of this resulting reaction force, utilizing the snow to be cleared. The snow lying above the holding-down members opposes an upward movement of the same to the extent of the displacement work to be done. This is determined on the one hand by the size and shape of the holding-back surfaces, formed by the upper sides 38 of the sliding shoes 30, and on the other hand, likewise, by the snow quality. The effectiveness of the sliding shoes 30 is thus greater, the further these project with their holding-back surfaces out of the area of action of the ploughing drum 20 into a layer of snow which is still intact. The most effective arrangement is obtained when their excess length projects forwards, that is to say in the direction of clearing. By virtue of the wedge-shaped design of the front ends 40, during the clear work, that is to say the forward movement of the rotary snow plough, a downwardly directed force component acts on the sliding shoes, which counteracts the tendency to run up onto the snow adhering to the ground 42.

From the above, it can be seen that the effect developed by the holding-back surfaces of the sliding shoes is greater, the greater the upwardly directed reaction force of the clearing treatment through the ploughing drum, which arises from the quantity and quality of the snow. With appropriate design, no unnecessary friction forces arise on the ground, therefore, when clearing on asphalt and there is no undesirable tendency to dig in if clearing is to be carried out on a blanket of snow.

The holding-down members according to the present invention additionally contribute to avoiding undesirable contact of the ploughing drum 20 with obstacles which are present in front of or beside the same. The connection pieces 32 also have a dual function, serving as safety shields which prevent unintentional proximity to the ploughing drum as well as for fastening the sliding shoes 30. For quiet travelling during clearing, that is to say with the sliding shoes resting on the ground, it is advantageous that these, as a result of the distance of the front ends 40 from the wheel axle 2, provide an increased running length.

The holding-down members can also have a form or arrangement which is different from that described and illustrated in the drawing. It is in particular conceivable, that they run towards one another, that is to say inwards in a curve, in the parts lying in front of the ploughing drum and thus ease maneuvering past obstacles.

Figure 3:
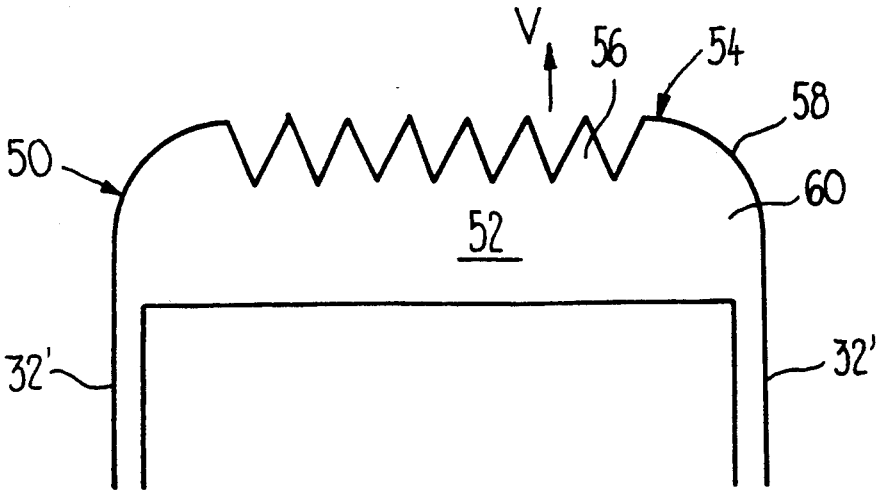
FIG. 3 shows likewise in plan view the second embodiment of the device according to the invention.

The device can of course also be formed by only a single holding-down member. In FIG. 3, the design of such a holding-down member is illustrated in plan view. In this exemplary embodiment, the holding-down member is likewise designed as a sliding shoe and indicated by 50. Two connection pieces 32' are connected in a manner corresponding to the arrangement according to FIG. 1 to the running gear (not shown) or a tractor. Between the two connection pieces 32' and rigidly connected thereto, a blade member 52 extends, which runs transversely to the forward direction of travel which is indicated by the arrow V. On its front side 54, the blade member 52 is edged over the greater part of its extent with teeth 56. On both sides of the teeth 56, the front side 54 ends in roundings 58 which in turn run towards the connection pieces 32'. The forwardly directed teeth 56 are designed in the manner of saw teeth. In profile, the blade member 52 tapers towards the front side 54 in the manner of a cutting edge. The upper side 60 and the lower side of the blade member 542 are formed by plane surfaces, the latter running, over its transverse extent, approximately parallel to the supporting surface and extending approximately tangentially to the circumference of the running gear wheels (not shown). Apart from steel, other tough metals or non-metal materials can be utilized for the material of the sliding shoe 50.

Figure 2:
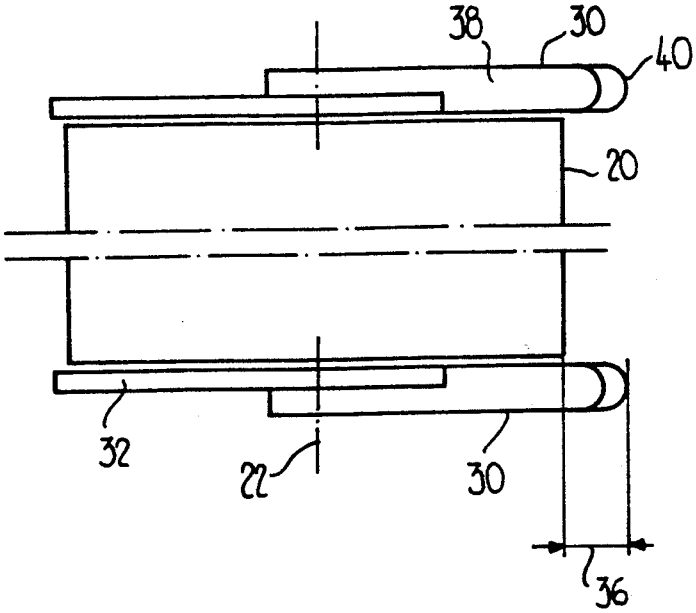
FIG. 2 illustrates on enlarged scale in plan view the position of the sliding shoes relative to the ploughing drum of the rotary snow plough according to FIG. 1, the other parts of the rotary plough being omitted.

The holding-down member illustrated in FIG. 3 acts in fundamentally the same manner as the holding-down members according to FIGS. 1 and 2, with its upper side 60 forming the holding-back surface. By virtue of its transverse extent, however, this holding-down member additionally provides a cutting action over the whole width of the ploughing drum. The cutting action is supported in this by the teeth 56. Accordingly, snow residues in areas which lie in front of and cannot be reached by the ploughing drum, for example, in front of walls, can be dug out and carried away. By virtue of profiling in the manner of a cutting edge, there is low resistance on forward movement.

The blade member 52 can also be formed by a plane plate, for example, made of sheet steel. This can be slightly downwardly inclined forwards and it may be expedient to provide the underside with sliding strips (not shown) a few millimeters thick, which each extend in continuation of the connection pieces 32'.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A device on rotary snow plough comprising:

a ploughing drum, a running gear and a motor drive connected to each other, holding-down means, connected to the running gear and being arranged in front of the ploughing drum, for holding down said rotary snow plough due to the weight of snow on top of said holding-down means, said holding-down means having an upwardly directed holding-back surface, the upwardly directed holding-back surface having a free surface area forward of a working area of the ploughing drum, said holding down means being curved inward in front of the ploughing drum and having a blade member which extends over the longitudinal length of the ploughing drum such that a portion of the blade member is directly forward of the working area of the ploughing drum, said blade member having forwardly directed teeth, said ploughing drum having only one axis, said holding-down means being rigidly fastened to a housing of said rotary snow plough by at least one connection piece.

2. A device according to claim 1, wherein the front ends of the holding-down means is of wedge-shape.

3. A device according to claim 1, wherein the holding-down means is rigidly connected to the running gear, said holding-down means being arranged approximately at ground level and being a sliding show.

4. A device according to claim 3, wherein the front ends of the holding-down means are of wedge-shape.

5. A device according to claim 1, wherein said holding-down means consists of a single holding-down member.

* * * * *